United States Patent [19]

Izen

[11] 3,941,251

[45] Mar. 2, 1976

[54] DISPLAY FIXTURE

[75] Inventor: Eliott H. Izen, Newton, Mass.

[73] Assignee: Crystal Craft Plastics Company, Inc., Central Falls, R.I.

[22] Filed: Oct. 15, 1974

[21] Appl. No.: 515,101

[52] U.S. Cl. ..... 211/177; 211/162

[51] Int. Cl.[2] ..... A47F 5/10

[58] Field of Search ..... 211/177, 162, 94, 87, 182, 211/175; 35/65; 40/64 R

[56] References Cited

UNITED STATES PATENTS

| | | | |
|---|---|---|---|
| 3,272,345 | 9/1966 | Wallace | 211/177 X |
| 3,425,568 | 2/1969 | Albright | 211/94 X |
| 3,556,308 | 1/1971 | McAleenan | 211/87 X |

*Primary Examiner*—Ramon S. Britts

*Attorney, Agent, or Firm*—Salter & Michaelson

[57] ABSTRACT

A display fixture for jewelry and the like comprising a plurality of upright, vertical stanchions having upper and lower channel members extending horizontally therebetween and a plurality of individual display racks, each having means thereon for mounting the jewelry or other articles to be displayed, said racks being readily mountable between said upper and lower channel members and being readily detachable therefrom.

4 Claims, 4 Drawing Figures

DISPLAY FIXTURE

BACKGROUND AND SUMMARY OF THE INVENTION

It has been found desirable to provide a display fixture for jewelry and the like having the capability of attractively and accessibly displaying a maximum amount of jewelry or other articles within a minimum space. It is also desirable to construct a fixture in such a way that it can be shipped in a knocked-down condition and then easily assembled at its point of intended use.

It is also desirable to provide a display fixture of this type having the capability of permitting jewelry or the like to be displayed to be mounted on individual display racks which may be quickly and easily attached to and detached from the fixture, whereby the orientation of the racks within the fixture may be easily and quickly changed where such becomes necessary or desirable for any reason.

In accomplishing the above objectives, the present invention provides a fixture comprising a plurality of upright, vertically disposed stanchions having aligned upper and lower channel members extending horizontally therebetween. The fixture further comprises a plurality of separate display racks each of which has means thereon for conveniently and attractively mounting and displaying the jewelry or other article to be displayed. Means are provided for permitting the individual racks to be quickly mounted between the upper and lower channel members and, likewise, to be quickly detached therefrom when necessary or desirable. Preferably the display racks are slidably mounted in the channel members; whereby when it is desired to re-orient the racks within the fixture, one rack may be detached and removed from the fixture, after which the remaining racks may be slidably moved to the desired new position, after which the removed rack may be easily and quickly re-mounted in a different position.

Other objects, features and advantages of the invention will become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
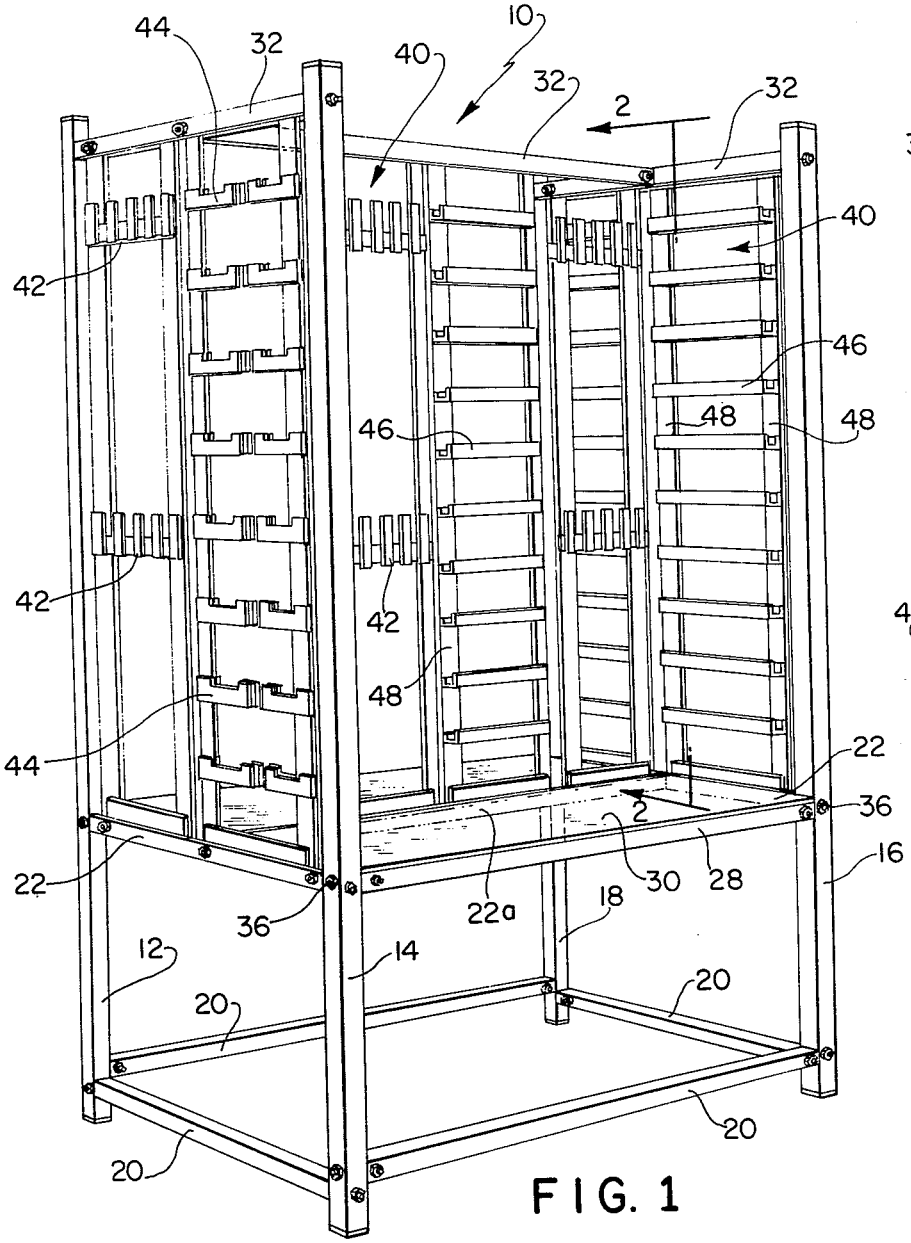
FIG. 1 is a perspective view of a preferred form of display fixture embodying the present invention.

Referring now to the drawings, and more particularly to FIG. 1 thereof, there is shown generally at 10 a display fixture embodying the present invention. The fixture 10 comprises a plurality of upright stanchions 12, 14, 16 and 18, each of which is preferably constructed of a lightweight tubular metal, such as aluminum. Horizontally extending support bars 20, preferably constructed of the same lightweight tubular metal, are secured to the stanchions by any suitable mechanical means and extend therebetween adjacent the lower extremities thereof in order to help rigidize the fixture 10.

Figure 2:
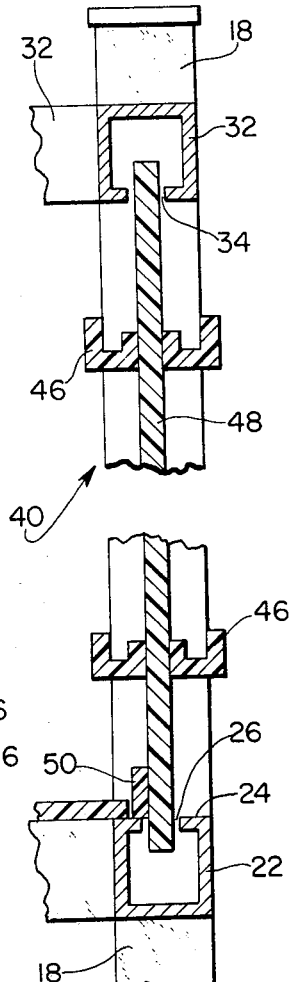
FIG. 2 is a fragmentary section, on an enlarged scale, taken on line 2—2 of FIG. 1.

Spaced somewhat above the support bars 20 are lower channel members 22, each of which is also preferably constructed of lightweight tubular metal and is of generally U-shaped configuration, as illustrated most clearly in FIG. 2, with a pair of inwardly extending flanges 24 at the top edge thereof defining an open portion 26. As will be seen most clearly in FIG. 1, the channel members 22 extend between the stanchions 12 and 14 and between the stanchions 16 and 18 with a third channel member 22*a* interconnecting the midpoints of the channel members 22 to define an H-shaped configuration. For purposes of rigidity, a support bar 28 may extend between the stanchions 14 and 16, and for storage of inventory and the like, a shelf 30 may be secured to the fixture at the level of support bar 28. Adjacent the top of the vertical stanchions there is provided upper channel members 32, also defining a generally H-shaped configuration, said upper channel members being in alignment with the aforesaid lower channel members. It will be understood that the upper channel members 32 are similarly constructed to the lower channel members except that whereas the open portion 26 of the lower channel members is upwardly disposed, the open portion 34 of the upper channel members is downwardly disposed.

Figure 3:
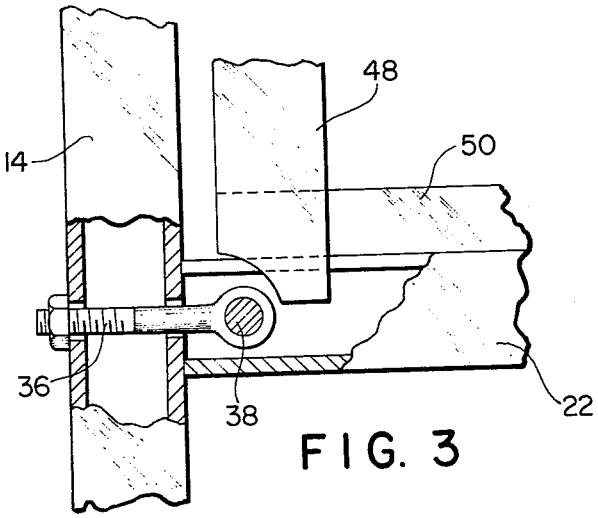
FIG. 3 is a fragmentary detailed view, partly in section, showing one form of mechanical connection between the stanchions and channel members.
Figure 4:
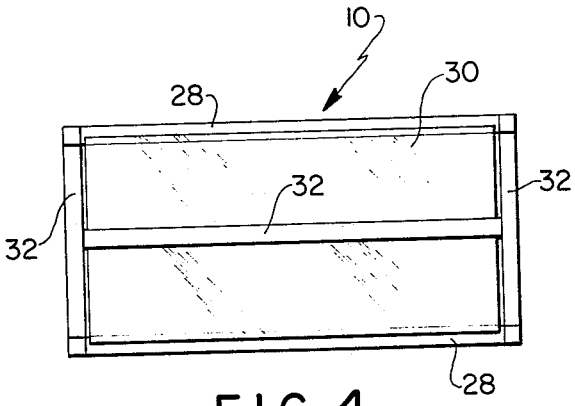
FIG. 4 is a top plan view of the fixture shown in FIG. 1.

In FIG. 3 there is illustrated one form of securing the channel members to the vertical stanchions, said securing means comprising an eye bolt 36 extending through the vertical stanchions with the eye portion of said bolt being located within the channel member and receiving therethrough a cross member 38 which is bolted to the channel member. Other equivalent mechanical connections could obviously also be utilized.

The means for displaying the jewelry, or other articles to be displayed, comprise individual display racks shown generally at 40, constructed of lucite or the like, to which is secured means for mounting and displaying the articles. For example, where the fixture 10 is used to display jewelry, which is a primary use of the present invention, certain of the racks 40 may have secured thereto the members 42, it being understood that these particular racks are for receiving and displaying ropes, chains, belts, etc. Other of the racks 40 have mounted thereon the means illustrated at 44, these being for receiving and displaying bracelets and the like. Other racks have channel-like means 46 secured thereto for receiving earring cards. As will be seen most clearly in FIG. 1, each rack 40 comprises a pair of spaced, upright strips 48 interconnected by the mounting means 42 and 46 and by a horizontally extending bearing strip 50 extending across and secured to the strips 48 adjacent to but spaced slightly above the bottom edges thereof, as illustrated most clearly in FIGS. 2 and 3. A similar strip may be provided adjacent the top of each rack for imparting additional rigidity thereto. As will be seen most clearly in FIG. 2, the height of each rack, i.e., the height of the strips 48, is slightly greater than the distance between the top of channel members 22 and the bottom of channel members 32. In order to insert one of the racks into the fixture, it is only necessary to slightly tilt the rack so that the upper edges of the strips 48 may be inserted upwardly through the open portion 34 sufficiently for the bottom edge of the strips 48 to clear the top of lower channel member 22. The rack 40 is then aligned with channel member 22, whereupon the lower edges of the strips 48 are allowed to drop down into the lower channel members until bearing strip 50 rests on the top of flange 24, as illustrated in FIG. 2. This maintains the upper edge of the strips 48 within the upper channel members 32 whereupon the panels are slidably mounted between the channel members. When it is desired to remove one of the rack members, it is simply necessary to lift the rack member upwardly until the bottom edge of the rack member clears lower channel 22, after which the rack is then tilted and the upper end withdrawn from upper channel member 32. It will thus be seen that the bearing strips 50 not only provide a smooth, continuous bearing surface for slidable movement of the racks within the fixture, but at the same time the strip 50 prevents the racks 40 from moving downwardly within the lower channel members 22 sufficiently to permit the upper edges of the racks 40 to clear the channel members 32.

It will therefore be seen that each of the rack members 40 may be quickly and easily mounted on the fixture 10 and may be just as easily and quickly detached whenever desired. As will be seen, a plurality of the rack members 40 may be mounted between each pair of upper and lower channel members, or, if desired, some of the rack members may be removed and not used if a lesser inventory of jewelry is to be displayed. In addition, if for any reason, aesthetic or otherwise, it is desired to relocate the individual racks within the fixture, this may easily be done by removing one or more of the racks, sliding the others to a different position, and then remounting the removed racks in a new location.

Although the fixture 10 has been shown as a free-standing unit, it will be understood that the basic concept of this invention is equally applicable to a counter display fixture. Also, it has been found to be particularly desirable to provide the fixture 10 in the H-shaped configuration shown; since if the fixture is positioned in an area where consumers may pass around the entire unit, then jewelry may be mounted and displayed on opposite sides of each rack 40. Obviously, the fixture 10 could also be of a rectangular configuration, rather than H-shaped; but then it would only be possible to mount and display the jewelry on the outer sides of racks 40. Even if the H-shaped fixture 10 is mounted in a location where access thereto is only from the front and the sides, it will be obvious that jewelry could be mounted and displayed on the outside of the side racks 40, on the front side of the racks positioned in channel 22*a*, as well as on the inside of the forwardmost side racks.

A highly advantageous feature of the present invention is the fact that the vertical stanchions, horizontal support bars, and horizontal channel members may be shipped disassembled and then easily assembled at their place of intended use. The racks 40, since they are substantially flat, provide no shipping problem. Once the vertical stanchions, horizontal support bars and horizontal channel members have been assembled, then the user may quickly mount those racks 40 which he desires to use, it being obvious that any desired orientation of the racks may be effected, i.e., earring racks may be next to the bracelet racks, or, if preferred, the earring racks may be next to the necklace racks, etc.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A display fixture comprising a plurality of vertically disposed stanchions, upper and lower horizontally disposed channel members connected to and extending between said stanchions, said upper channel member having a downwardly disposed open portion extending along its length and said lower channel member having an upwardly disposed open portion extending along its length, and a plurality of separate display racks removably mounted between said channel members, said racks being dimensioned so that the top of each rack may be inserted into the open portion of the upper channel member and then the bottom of each rack swung into alignment with the open portion of the lower channel member and dropped therein whereby when the rack comes to rest in said lower channel member, the top edge of the rack is still retained within the upper channel member, and means on said racks for mounting articles to be displayed, said racks being slidable along said channel members, and said racks each having a bearing strip secured to and extending horizontally thereacross adjacent to but spaced from the bottom edge of the rack, said bearing strip engaging the top of the lower channel member to limit downward movement of the rack therein, whereby said bearing strip rides on the top of said lower channel member when the racks are slidably moved, the dimension from the bottom edge of each of said racks when in said channel members to the open portion in the upper channel member being substantially less than the dimension from the innermost end of the lower channel member to the open portion in the upper channel member, and the dimension from the bottom edge of said bearing strip on each rack to the top edge of said rack being greater than the dimension from the open portion in the lower channel member to the open portion in the upper channel member but less than the dimension from the open portion in the lower channel member to the innermost end of the upper channel member.

2. In the display fixture of claims 1, said lower channel member being of generally U-shaped configuration, with inwardly extending flanges on the top edge thereof defining said open portion, said bearing strip making engagement with one of said flanges.

3. In the display fixture of claim 1, said stanchions and channel members defining an H-shaped configuration when viewed in plan, said mounting means being provided on opposite sides of said racks.

4. In the display fixture of claim 2, said upper channel member also being of generally U-shaped configuration, with inwardly extending flanges on the bottom edge thereof defining said open portion.

* * * * *